US009237806B2

(12) United States Patent
Cheng

(10) Patent No.: US 9,237,806 B2
(45) Date of Patent: Jan. 19, 2016

(54) SLIDING TRACK ASSEMBLY

(75) Inventor: Hsin-Lang Cheng, New Taipei (TW)

(73) Assignee: ATEN INTERNATIONAL CO., LTD., Shijr (TW)

( * ) Notice: Subject to any disclaimer, the term of this patent is extended or adjusted under 35 U.S.C. 154(b) by 162 days.

(21) Appl. No.: 13/449,242

(22) Filed: Apr. 17, 2012

(65) Prior Publication Data

US 2013/0272633 A1 Oct. 17, 2013

(51) Int. Cl.
*A47B 95/00* (2006.01)
*A47B 88/10* (2006.01)

(52) U.S. Cl.
CPC ..... *A47B 88/10* (2013.01); *A47B 2210/007* (2013.01); *A47B 2210/0016* (2013.01); *A47B 2210/0032* (2013.01); *A47B 2210/0059* (2013.01); *A47B 2210/0081* (2013.01)

(58) Field of Classification Search
USPC ..... 312/333, 334.44–334.47
See application file for complete search history.

(56) References Cited

U.S. PATENT DOCUMENTS

| | | | | |
|---|---|---|---|---|
| 4,469,384 | A * | 9/1984 | Fler et al. | 312/333 |
| 4,696,582 | A * | 9/1987 | Kasten | 384/18 |
| 6,155,661 | A * | 12/2000 | O'Neil et al. | 312/334.44 |
| 6,224,178 | B1 * | 5/2001 | Cirocco | 312/334.46 |
| 6,244,678 | B1 * | 6/2001 | Dopp et al. | 312/333 |
| 6,464,311 | B2 | 10/2002 | Liang et al. | |
| 7,467,833 | B2 * | 12/2008 | Weng | 312/221 |
| 7,520,577 | B2 * | 4/2009 | Chen et al. | 312/334.46 |
| 2003/0209959 | A1 * | 11/2003 | Shih-Long et al. | 312/334.46 |
| 2008/0224585 | A1 | 9/2008 | Wu et al. | |
| 2012/0169199 | A1 * | 7/2012 | Chen et al. | 312/334.44 |

FOREIGN PATENT DOCUMENTS

| | | | |
|---|---|---|---|
| CN | 201977218 | U | 9/2011 |
| DE | 20210858 | U1 | 9/2002 |
| GB | 2494722 | | 3/2013 |
| JP | 3173976 | U | 2/2012 |
| TW | M325375 | | 1/2008 |
| TW | M358569 | | 6/2009 |
| TW | M359248 | | 6/2009 |

OTHER PUBLICATIONS

Taiwanese Office Action, dated Jun. 6, 2014, in a counterpart Taiwanese patent application, No. TW 101118819.

(Continued)

*Primary Examiner* — Daniel J Troy
*Assistant Examiner* — Timothy M Ayres
(74) *Attorney, Agent, or Firm* — Chen Yoshimura LLP

(57) ABSTRACT

A sliding track assembly including a first, second and third rails, the second rail slidably mounted on the first rail, and the third rail slidably mounted on the second rail, so that the second and third rail can move relatively to the first rail and to each other. The sliding tract assembly also includes a latch member mounted on the third rail near its outer end and having two resilient or/and compressible portions each having asymmetric inward and outward facing slopes, and a lock member mounted or formed on the second rail near its outer end. The third rail can move together with the second rail when the latch member and the lock member are engaged, and the third rails can move freely by itself when the latch member and the lock member are disengaged.

17 Claims, 14 Drawing Sheets

(56) References Cited

OTHER PUBLICATIONS

Taiwanese Office Action, dated Sep. 18, 2014, in a counterpart Taiwanese patent application, No. TW 101118819.

Chinese Office Action, dated Mar. 23, 2015, in a counterpart Chinese patent application, No. CN 201210197936.9.

* cited by examiner

SLIDING TRACK ASSEMBLY

BACKGROUND OF THE INVENTION

1. Field of the Invention

This invention generally relates to sliding track assemblies, and in particular, it relates to sliding track assemblies used to moveably mount platforms, drawers or chassis to cabinets, storage shelves or equipment racks.

2. Description of the Related Art

Conventional sliding track assemblies have been used for moveably mounting platforms, drawers or device chassis to cabinets, storage shelves or equipment racks. A typical sliding track assembly includes an outer rail, an intermediate rail and an inner rail. The rails have formed edges and are assembled together in sliding engagement so that the inner and intermediate rails can move telescopically relative to each other and the stationary outer rail between extended and retracted positions. Two opposite sliding track assemblies are usually used to mount a platform or chassis. The stationary outer rails of the two sliding track assemblies are secured in a rack or cabinet in a spaced apart alignment, the movable inner rails are secured to the opposites sides of the platform or chassis, and the inner rails interconnect the outer and inner rails of the sliding track assemblies respectively, such that the platform or chassis may be pulled out of the rack or cabinet to an extended position to be used in a cantilevered support arrangement, and pushed back into the rack or platform to a retracted position when not in use.

Various releasable engagement mechanisms have been developed for regulating the relative movement of the telescoped rails. For example, U.S. Pat. No. 6,464,311 issued to Liang et al. on Oct. 15, 2002 for "Lock and Release Mechanism for Slide Assembly" disclosed a slide assembly having a lock and release mechanism which includes a flexible strip attached to an intermediate rail. The flexible strip has a fork at one end which is locked by a stopper on the outer rail as the intermediate rail is extended to the locked out position.

It is desirable to provide a sliding track assembly with a releasable engagement mechanism that is simple and low cost to produce yet easy and smooth to use.

SUMMARY OF THE INVENTION

The following summary extracts and compiles some of the features of the present invention, while other features will be disclosed in the follow-up detailed descriptions of the invention. It is intended to cover various modifications and similar arrangements included within the spirit and scope of the appended claims.

It is an object of the present invention to provide a sliding track assembly with a releasable engagement mechanism.

According to the exemplary embodiments of the present invention, there is provided a sliding track assembly, which includes a first rail having an elongated body with an inner end and an outer end, a second rail having an elongated body with an inner end and an outer end, the second rail slidably mounted on and supported by the first rail such that the second rail is movable relative to the first rail between a retracted position and an extended position, and a third rail having an elongated body with an inner end and an outer end, the third rail slidably mounted on and supported by the second rail such that the third rail is movable relative to the first rail and second rail between a fully retracted position, a halfway position and a fully retracted position.

The slidable track assembly also includes a latch member and a lock member. The latch member has a base having an inner side and an outer side and two opposite lateral edges, the base having a positioning feature engaged with a complimentary positioning feature provided on the third rail, such that the latch member is mounted on the third rail at a position near the outer end of the third rail with the two lateral edges of the latch member parallel to the elongated body of the third rail, wherein the latch member has at least one resilient or/and compressible portion rising above and between the inner and outer sides of the base of the latch member, the at least one resilient or/and compressible portion having an inward facing slope (inner slope) arising from the inner side of the base and an outward facing slope (outer slope) arising from the outer side of the base, and a curved portion interconnecting the inward facing and outward facing slopes, wherein the outward facing slope has a portion steeper than the inward facing slope. The lock member is mounted or formed on the second rail at a position adjacent to the outer end of the second rail for engaging and compressing the resilient or/and compressible feature of the latch member from either an inward direction or an outward direction. The latch and lock members provides a releasable engagement mechanism, so that the third rail can move together with the second rail when the latch member and the lock member are engaged, and the third rails can move freely by itself when the latch member and the lock member are disengaged.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

It is to be understood that both the foregoing general description and the following detailed description are exemplary and explanatory and are intended to provide further explanation of the invention as claimed.

DETAILED DESCRIPTION OF THE PREFERRED EMBODIMENTS

As required, a detailed illustrative embodiment of the present invention is disclosed herein. However, techniques, systems and operating structures in accordance with the present invention may be embodied in a wide variety of forms and modes, some of which may be quite different from those in the disclosed embodiment. Consequently, the specific structure and functional details disclosed herein are merely representative, yet in that regard, they are deemed to afford the best embodiment for purposes of disclosure and to provide a basis for the claims herein, which define the scope of the present invention. The following presents a detailed description of the preferred embodiment (as well as other alternative embodiments) of the present invention.

Figure 1:
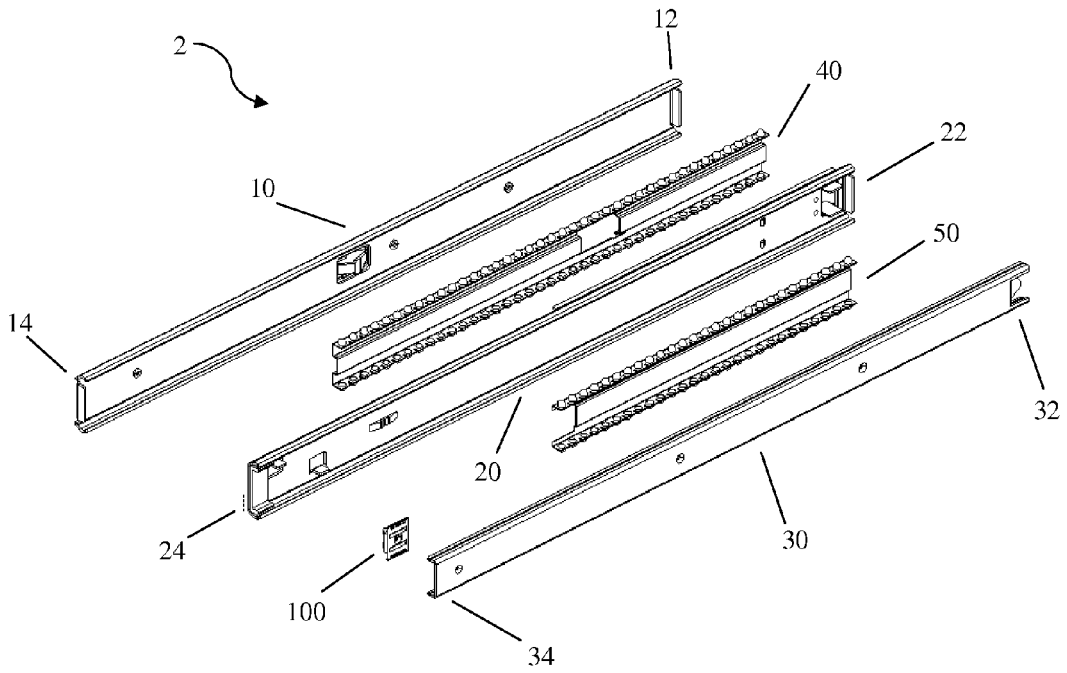
FIG. 1 is an exploded view diagram of a sliding track assembly in accordance with an embodiment of the present invention.

One preferred embodiment of the present invention provides a sliding track assembly 2 as shown in FIG. 1.

Referring to FIG. 1, the sliding track assembly 2 includes a first rail 10, a second rail 20 and third rail 30. The second rail 20 can be movably mounted to and supported by the first rail 10 with an interconnecting mechanism such as a ball bearing mechanism 40 so that the first and second rails 10 and 20 are assembled together in sliding engagement whereas they can move telescopically relative to each other and more particularly, when the first rail 10 is stationary, the second rail 20 can move between a retracted position and an extended position. Similarly, the third rail 30 can be movably mounted to and supported by the second rail 20 with an interconnecting mechanism such as a ball bearing mechanism 50 so that the second and third rails 20 and 30 are assembled together in sliding engagement whereas they can move together or telescopically relative to each other and more particularly, the third rail 30 can move between a fully retracted position, a halfway position and a fully extended position.

The track assembly 2 may be used for moveably mounting platforms, drawers or device chassis to cabinets, storage shelves or equipment racks (not shown). For example, the first rail 10 can be mounted to a rack or cabinet, the third rail 30 can be mounted to a side of the platform or chassis, and the second rail 20 interconnects the first and third rails 10 and 30, such that the platform or chassis may be pulled out of the rack or cabinet to a fully extended position to be used in a cantilevered support arrangement, and pushed back into the rack or platform to a fully retracted position when not in use, or any positions there-between.

As seen in FIG. 1, in the sliding track assembly 2 in accordance with an embodiment of the present invention, the first rail 10 has an elongated body with an inner end 12 and an outer end 14, the second rail 20 has an elongated body with an inner end 22 and an outer end 24, and the third rail 30 has an elongated body with an inner end 32 and an outer end 34. A latch member 100 is mounted at a position adjacent to or near the outer end 34 of the third rail 30.

Figure 2:
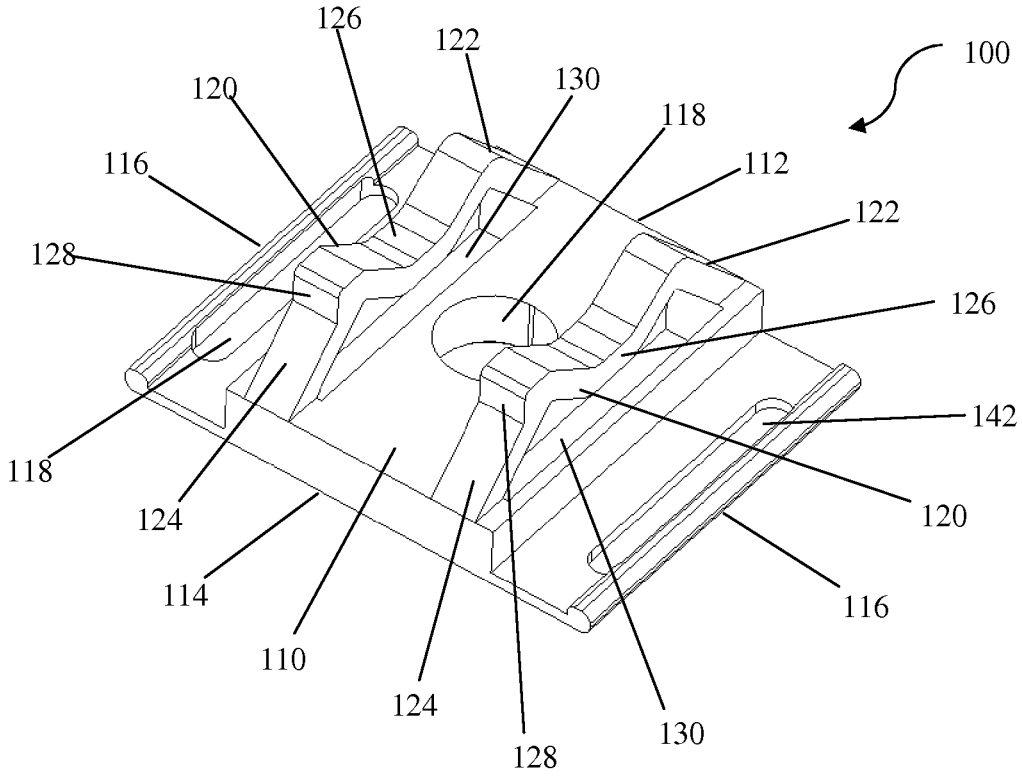
FIG. 2 is a perspective view diagram of a latch member of the sliding track assembly in accordance with the embodiment of the present invention shown in FIG. 1.

Referring to FIG. 2, the latch member 100 in accordance with an exemplary embodiment of the present invention has a base 110. The base 110 has an inner side 112 and an outer side 114 and two opposite lateral edges 116. The base also has a positioning feature 118. The positioning feature 118, for example, can be a small aperture at the middle of the base 110.

Figure 3:
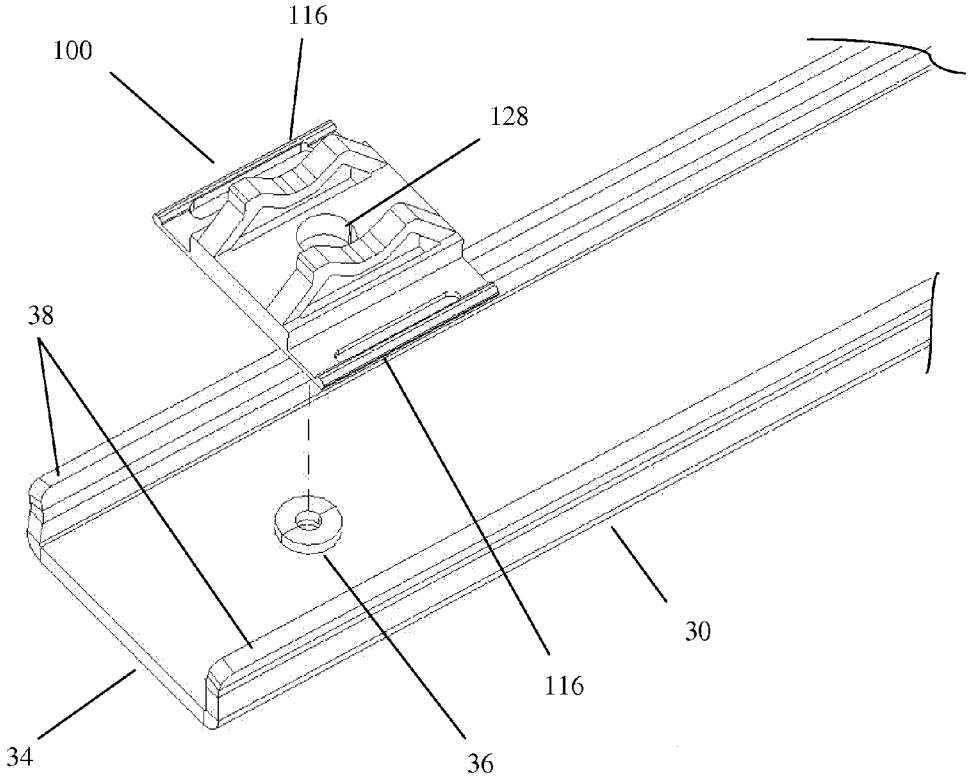
FIG. 3 is an exploded perspective view diagram showing the mounting of the latch member on the third rail of the sliding track assembly in accordance with the embodiment of the present invention.

Referring to FIG. 3, a complimentary positioning feature 36 is provided on the third rail 30, such that the latch member 100 can be mounted on the third rail 30 at a position near the outer end 34 of the third rail 30 with the two lateral edges 116 of the latch member 100 parallel to the elongated body of the third rail 30. The complimentary positioning feature 36 may be a small pin, disc or ring protruding from the floor of the third rail 30.

Figure 4:
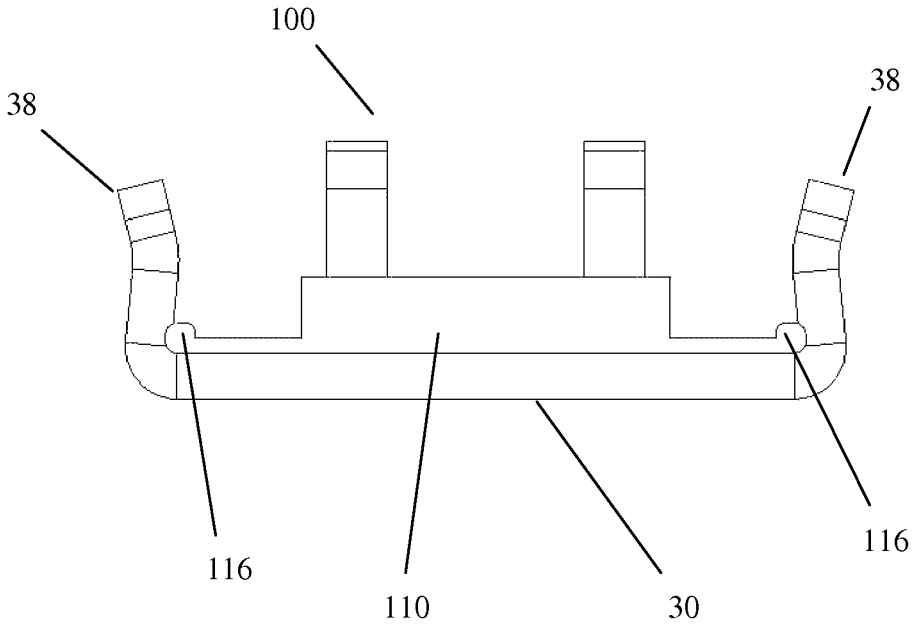
FIG. 4 is an end view diagram showing the latch member mounted on the third rail of the sliding track assembly in accordance with the embodiment of the present invention.

Referring to FIGS. 2-4, the third rail 30 has two opposite formed edges 38 extending along its elongated body (the first and second rails 10 and 20 may have similar formed edges). When the latch member 100 is mounted to the third rail 30, it is snuggly fitted between the formed edges 38 of the third rail 30. The lateral edges 116 of the base 110 of the latch member 100 may be slightly enlarged and a matching groove at the bottom of the formed edges 38 may be provided to further secure the latch member 100 in position. When latch member 100 is installed onto the rail 30, it may be slightly bent to squeeze between the formed edges 38 of the third rail until it snap into position. Elongated narrow openings 118, 142 may be provided respectively along the two lateral edges 116 to increase the flexibility of the base 110 of the latch member 100.

As an example, the latch member 100 may be made of plastic material which allows its base 110 to be slighted bent.

The latch member 100 also has one or more resilient or/and compressible portions 120 rising above the base 110 and extending and between the inner side 112 and outer side 114 of the base 110. In the embodiment shown in FIGS. 2-4, the latch member has resilient or/and compressible portions 120. However, other arrangements may also be utilized. For example, one wider resilient or/and compressible feature, or three or more narrower resilient or/and compressible features, may also be used. In addition, when more than one of such features are used, their detailed shapes or configurations may be slight different, although preferably they remain the same.

In the exemplary embodiment shown in FIGS. 2-4, the configurations of the two resilient or/and compressible portions 120 are the same so only one will be described here. The resilient or/and compressible portions 120 has an inward facing slope 122 arising from the inner side 112 of the base 110, an outward facing slope 124 arising from the outer side 114 of the base 110, and an interconnecting portion 126 which may have a curved contour. The inward facing and outward facing slopes 122 and 124 are asymmetric.

For example, the outward facing slope 124, or at least a portion 128 thereof, is steeper 128 than the inward facing slope 122. The significance of this detail will be apparent from the description below.

Figure 5:
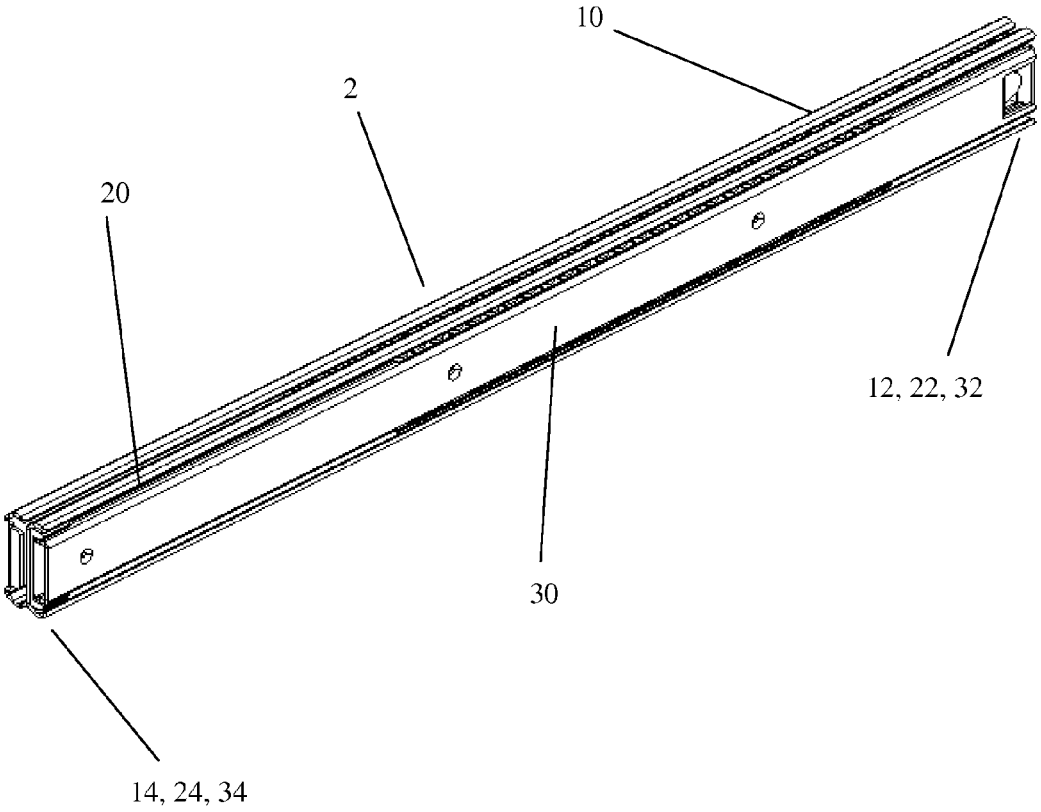
FIG. 5 is a perspective view diagram showing the third rail of the slidable track assembly in its fully retracted position in accordance with the embodiment of the present invention.

Referring to FIG. 5, there is shown a perspective view diagram a slidable track assembly 2 in accordance with an embodiment of the present invention fully retracted. When the slidable track assembly 2 is fully retracted, the respective inner ends 12, 22 and 32 of the first, second and third rails 10, 20 and 30 are all aligned, and the respective outer ends 14, 24 and 34 of the first, second and third rails 10, 20 and 30 are also all aligned.

Figure 6:
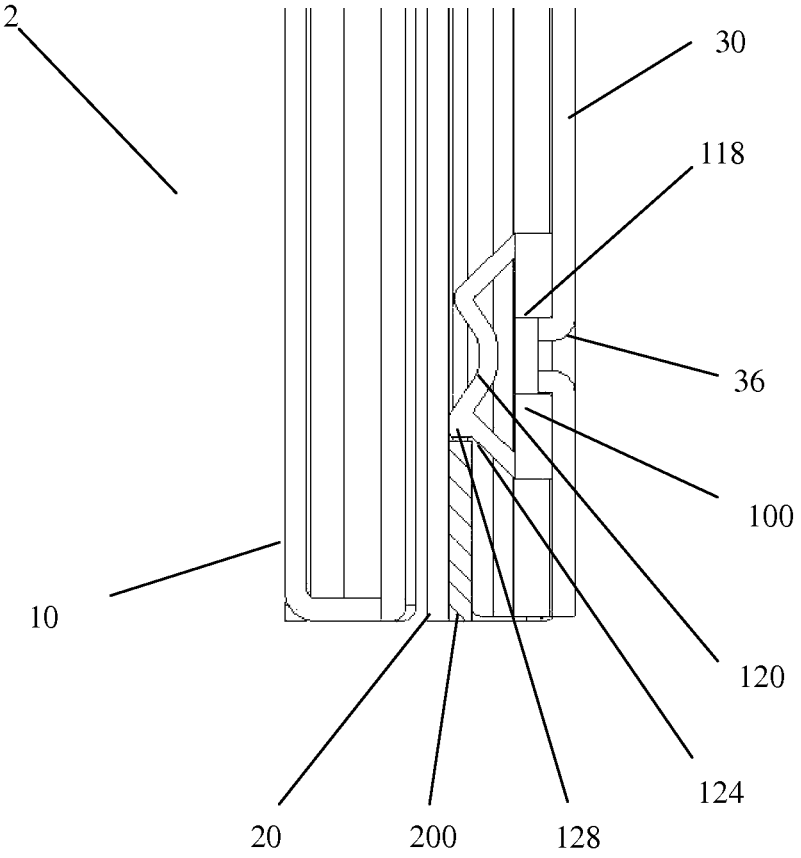
FIG. 6 is a partial cross-sectional view diagram showing the latch member engaged with the lock member of the slidable track assembly when the third rail is in its fully retracted position in accordance with the embodiment of the present invention.

Referring to FIG. 6, the slidable track assembly 2 further includes a lock member 200 mounted on the second rail 20 at a position near the outer end of the second rail. The latch member 100 and the lock member 200 provide a releasable engagement mechanism. As seen in FIG. 6, the lock member 200 has a profile for engaging the slopes of the resilient or/and compressible portion 120 of the latch member 100 from either side. FIG. 6 shows a partial cross-sectional view of the latch member 100 engaged with and the lock member 200 of the slidable track assembly 2 when the third rail 30 is in its fully retracted position in accordance with the embodiment of the present invention. At this fully retracted position, the lock member 200 is engaged with steep portion 128 of the outer side slope 124 of the resilient or/and compressible portion 120 of the latch member 100.

When the third rail 30 is pulled moving outwardly, the latch member 100 engages the lock member 200, which causes the second rail 20 to move together with the third rail 30. The steep portion 128 of the outward facing slope 124 of the resilient or compressible portion 120 of the latch member 100 is designed to increase the force needed for the lock member 200 to compress the resilient or/and compressible portion 120 of the latch member 100 so that the latch member 100 may overcome and break away from the lock member 200 such that the third rail 30 can move out from the second rail 20 and be further extended. As long as this overcome force needed is stronger than the small friction between the first and second rails 10 and 20, the second rail 20 will move together with the third rail 30 because of the engagement of the latch member 100 and lock member 200 of the slidable track assembly 2.

Another detail shown in FIG. 6 (in addition to FIG. 3) is the position feature of the latch member 118 and the complimentary position feature provided on the third rail 30. As shown in FIGS. 3 and 6, a small ring punched out from the flat floor of the third rail 30 extends into the small aperture 118 on the base of the latch member 100 to ensure that the latch member 100 is properly positioned. Of course other types of position and complimentary position features may be utilized.

Figure 7:
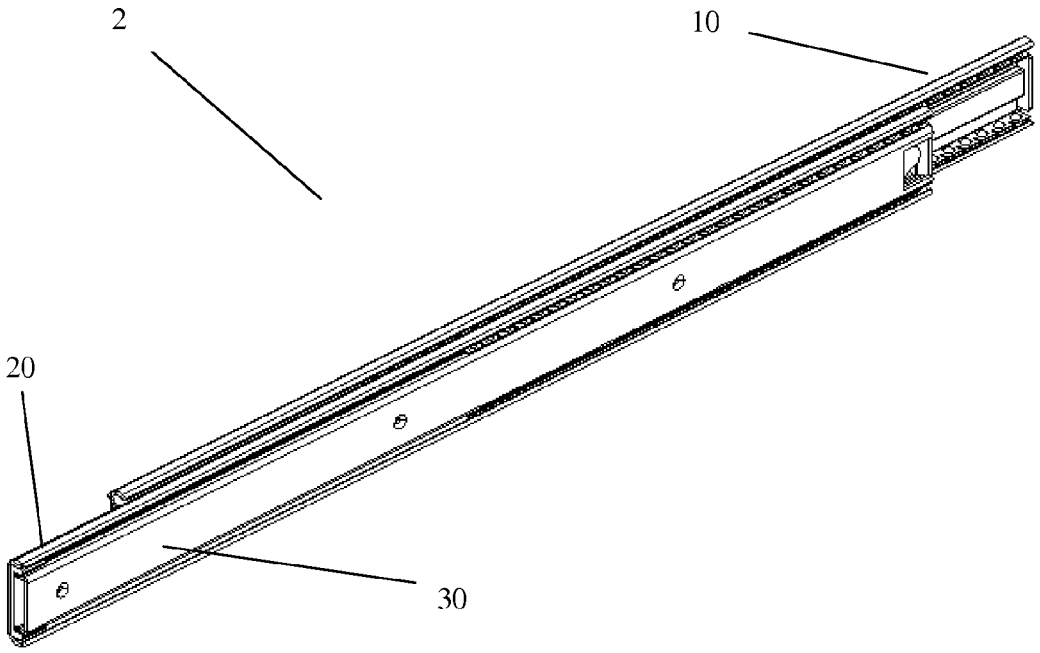
FIG. 7 is a perspective view diagram showing the second and third rails of the slidable track assembly move together when the latch member is engaged with the lock member in accordance with the embodiment of the present invention.
Figure 8A:
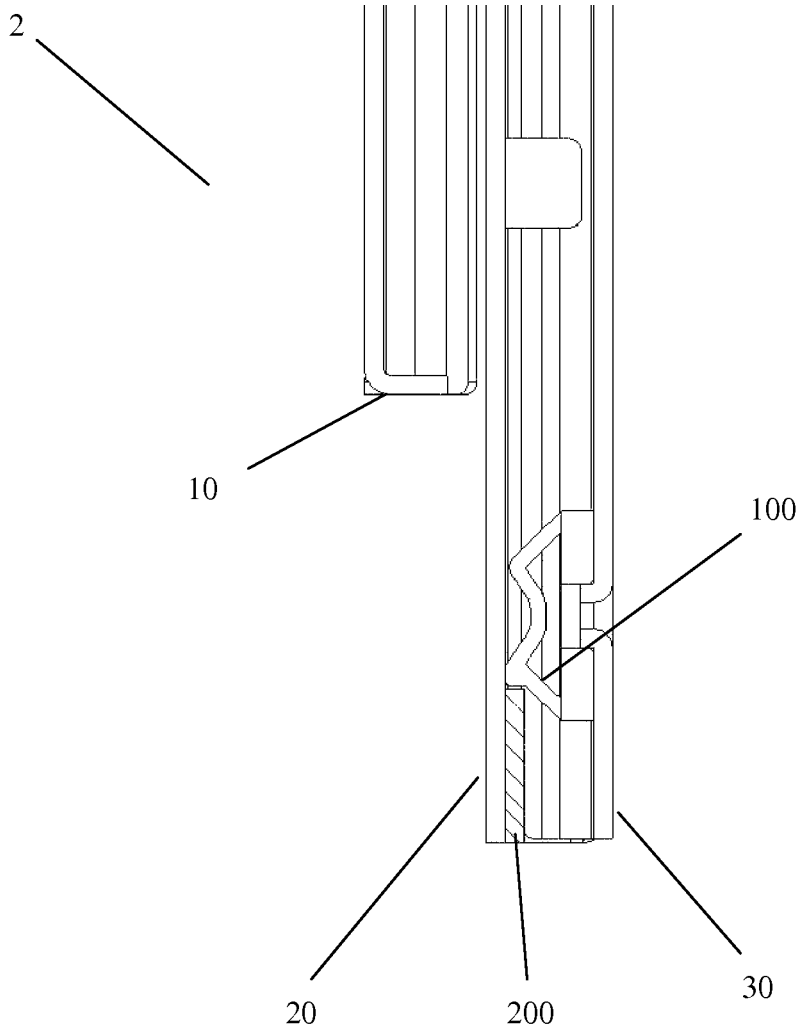
FIG. 8A is a partial cross-sectional view diagram showing the latch member engaged with the lock member of the slidable track assembly when the second and third rails move together in accordance with the embodiment of the present invention.
Figure 9A:
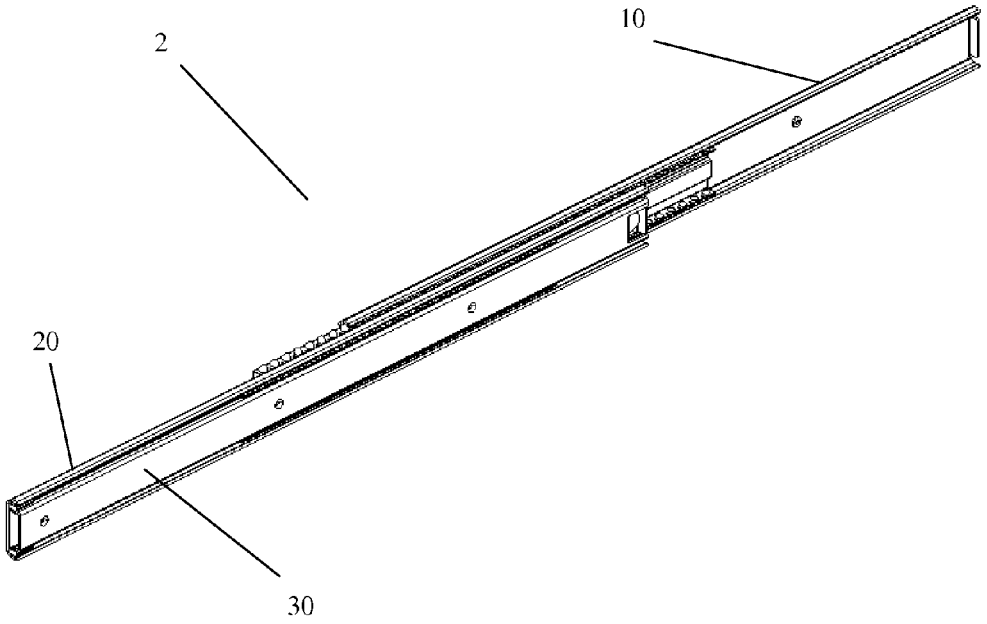
FIG. 9A is a perspective view diagram showing the second rail at its extended position while the third rail is at its retracted position in accordance with the embodiment of the present invention.

Referring to FIGS. 7 and 8A, there is shown the second and third rails 20 and 30 of the slidable track assembly 2 will move together when the latch member 100 is engaged with the lock member 200 in accordance with the embodiment of the present invention. As mentioned above, when the third rail 30 is pulled outwardly from its fully retracted position, the second rail 20 will move together with the third rail 30 because the latching member 100 is engaged with the lock member 200. This will continue until the second rail 20 reaches its extended position, as shown in FIG. 9A.

Figure 8B:
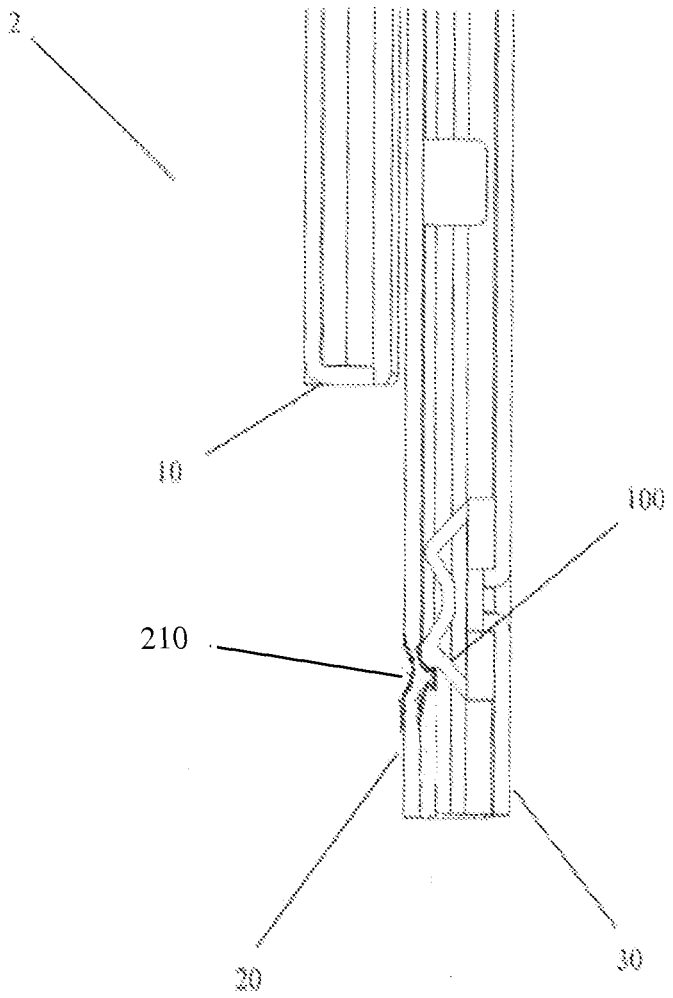
FIG. 8B is a partial cross-sectional view diagram showing the latch member engaged with the bumping feature formed on the second rail when the second and third rails move together in accordance with the embodiment of the present invention.

Referring to FIGS. 7 and 8B, there is shown an alternative to the lock member 200 in accordance with another embodiment of the present invention. Instead of the locking member 200, a bumping or bulging feature 210 is formed on the floor of the second rail 20 to serve the same function as the locking member 200. Again, when the third rail 30 is pulled outwardly from its fully retracted position, the second rail 20 will move together with the third rail 30 because the latching member 100 is engaged with the bumping or bulging feature 210. This will continue until the second rail 20 reaches its extended position, as shown in FIG. 9A.

Figure 8C:
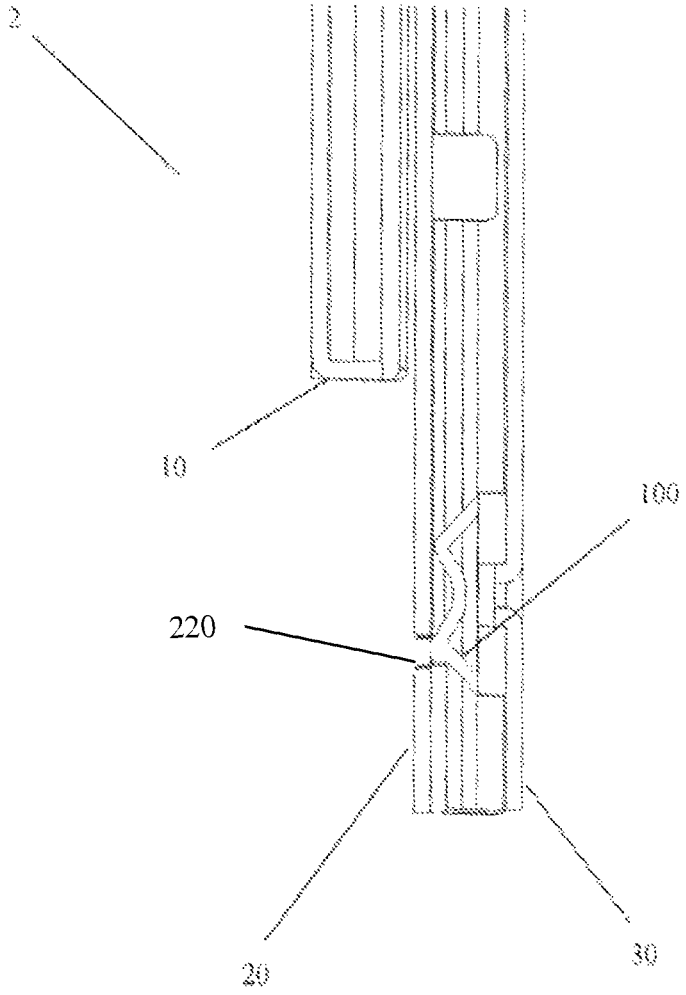
FIG. 8C is a partial cross-sectional view diagram showing the latch member engaged with the aperture formed on the second rail when the second and third rails move together in accordance with the embodiment of the present invention.

Referring to FIGS. 7 and 8C, there is shown another alternative to the lock member 200 in accordance with a further embodiment of the present invention. Instead of the locking member 200, an aperture 220 is formed on the floor of the second rail 20 to serve the same function as the locking member 200. Again, when the third rail 30 is pulled outwardly from its fully retracted position, the second rail 20 will move together with the third rail 30 because the latching member 100 is engaged with the edge of the aperture 220. This will continue until the second rail 20 reaches its extended position, as shown in FIG. 9A Referring to FIG. 9A, there is shown that the second rail 20 at its extended position while the third rail is at its halfway position in accordance with the embodiment of the present invention. At this point the second rail hits a hard stop and cannot be extended any further. This is also the halfway position of the third rail 30. From this halfway position, if the third rail 30 is still pulled outwardly, the lock member 200 will begin compressing the resilient or/and compressible portion 120 of the latch member 100. The lock member 200 (or the bumping feature 210 or the edge of the aperture 220) will compress the latch member 100 when the lock member 200 (or the bumping feature 210 or the edge of the aperture 220) is "aligned" with the latch member 100 while the resilient or/and compressible portion 120 of the latch member 100 is slightly compressed under the lock member 200.

By way of example, the latch member 100 may be made of plastic material, such that the resilient or/and compressible portion 120 may be slightly compressed, but will return back to its uncompressed form when it is not compressed. In addition, the latch member 100 may be an integral piece made from an injection molding process or other processes that make the latch member 100 in a one-piece member without assembled, attached, affixed or fastened parts or components.

Figure 9B:
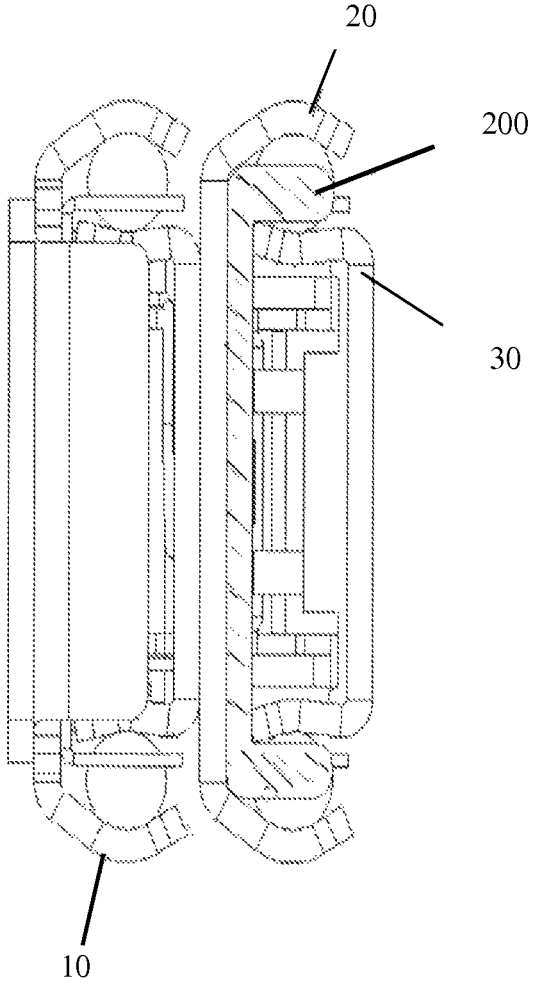
FIG. 9B is a front end view diagram showing the latch member in a locked state when the second rail is at its extended position while the third rail is at its retracted position in accordance with the embodiment of the present invention.

Referring to FIG. 9B, there is shown a front end view illustrating the latch member 100 in a locked state when the second rail 20 at its extended position while the third rail 30 is at its halfway position. In this locked state, the latch member 100 is engaged with the lock member 200 (or the bumping feature 210 or the edge of the aperture 220, not shown in FIG. 9B).

Keep pulling the third rail 30 outwardly will cause the lock member 200 (or the bumping feature 210 or the edge of the aperture 220) eventually overcome the steep portion 128 of the outward facing slope 124 when the force pulling the third rail 30 outwardly is strong enough. As soon as the latch member 100 passes the lock member 200 (or the bumping feature 210 or the edge of the aperture 220), they are no longer engaged and the third rail 30 breaks away and moves by itself, extending out of the second rail 20 and free to be continuously extended outwardly until it reaches its fully extended position, as shown in FIG. 10A.

Figure 10A:
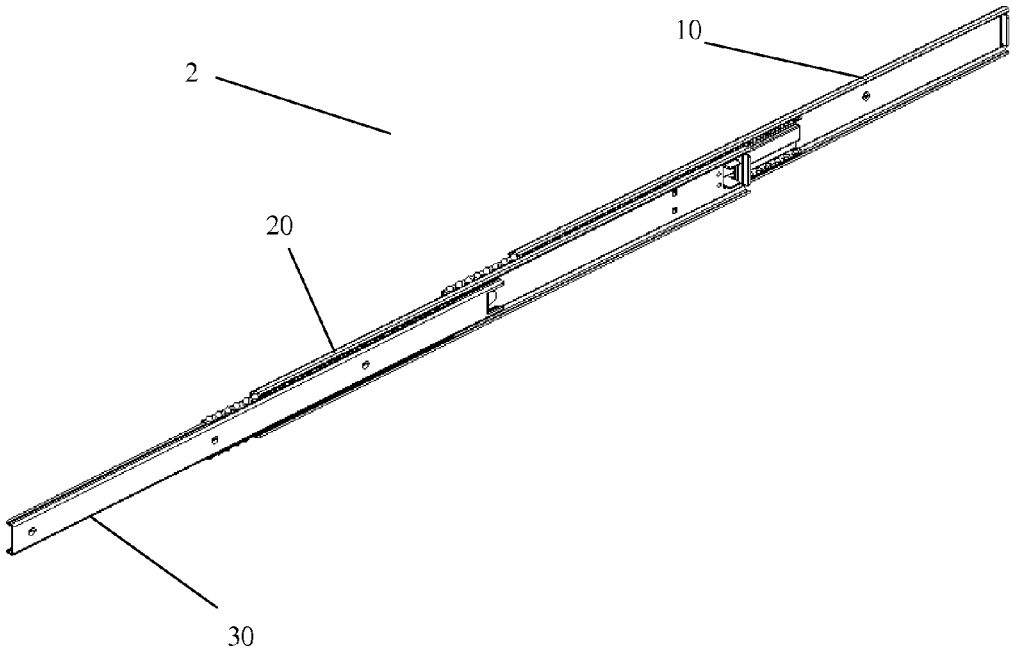
FIG. 10A is a perspective view diagram showing the second rail at its extended position while the third rail is at its fully extended position in accordance with the embodiment of the present invention.
Figure 10B:
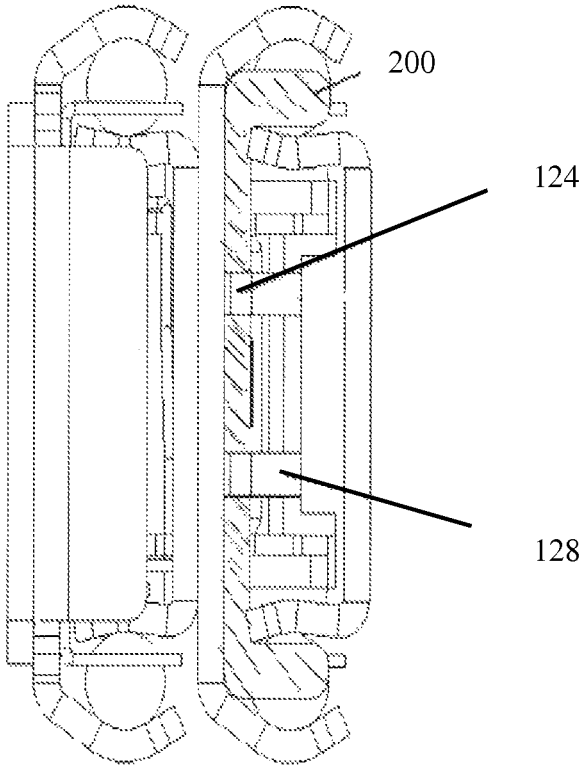
FIG. 10B is a front end view diagram showing the latch member in a released state when the second rail is at its extended position while the third rail is at its fully extended position in accordance with the embodiment of the present invention

Referring to FIG. 10B, there is shown a front end view diagram illustrating the latch member 100 in a released state when the second rail 20 is at its extended position while the third rail 30 is at its fully extended position. In this released state, the latch member 100 is disengaged from and has "overcome" or "passed" the lock member 200 (or the bumping feature 210 or the edge of the aperture 220, not shown in FIG. 10B).

When the third rail 30 is pushed back inwardly from its fully extended position (as shown in FIG. 10A), it will move by itself until the inward facing slope 122 of the resilient or/and compressible portion 120 engages the lock member 200 mounted at the outer end of the second rail 20. The third rail 30 is now approximately at its halfway position. Continuously pushing the third rail 30 inwardly towards its fully retracted position may yield two results.

First, since the inward facing slope 122 does not have a steep portion, it is relatively easier to overcome, such that pushing the third rail 30 with a slightly more speed or force may cause the lock member 200 on the second rail 20 to compress the resilient or/and compressible portion 120 of the latch member 100 so the latch member 100 overcomes the lock member 200. As a result, the third rail 30 can be continuously pushed-in freely by itself until it is fully aligned with the second rail 20 (i.e., at the retract position of the second rail), and from that point on the second and third rails 20 and 30 can be pushed-in together under they reach the fully retracted position.

Alternatively, if the latch member 100 does not overcome the lock member 200 when the inward facing slope 122 engages with the lock member 200 as the third rail 30 is pushed-in, the engagement of the latch member 100 and lock member 200 will cause the second rail 20 to move together with the third rail 30. When the second rail reaches its retracted position, it will hit a hard stop and cannot move any further inwardly. At this point if the third rail 30 is further pushed, the lock member 200 will press upon the inward facing slope 122 of the resilient or compressible portion 120 of the latch member 100 and causes the resilient or/and compressible portion 120 to be compressed.

When the latch member 100 overcomes the lock member 200, the outer rail can be pushed all the way into its fully retracted position as shown in FIGS. 5-6. It is noted that because of the asymmetric profiles of the inward facing slope 122 and outward facing slope 124, the force required for the latch member 100 to overcome the lock member 200 when the third rail 30 is moving inwardly relative to the second rail 20 is smaller than the force required for the latch member 100 to overcome the lock member 200 when the third rail 30 is moving outwardly relative to the second rail 20. This means that it is relatively easier to push the third rail 30 all the way back into its fully retracted position.

The present invention slidable track assembly has many advantages. The new latch member is simple in design, inexpensive to produce and easy to assemble with the third rail without tools. The asymmetric design of the resilient or/and compressible feature of the latch member makes the slidable track assembly more smooth and less effort to use.

Although examples of the preferred embodiments of the present invention system and method are shown and described in detail above, the present invention is not limited to the specifics described herein.

It will be apparent to those skilled in the art that various modification and variations can be made in the system and method of the present invention without departing from the spirit or scope of the invention. Thus, it is intended that the present invention cover modifications and variations that come within the scope of the appended claims and their equivalents.

What is claimed is:

1. A sliding track assembly, wherein the sliding track assembly includes a first rail, a second rail and a third rail each having an inner end and an outer end, the second rail is slidably mounted on and supported by the first rail, and the third rail is slidably mounted on and supported by the second rail, the sliding track assembly comprising:

a latch member mounted on the third rail of the third rail, and having at least one resilient or compressible asymmetric portion, wherein the least one resilient or compressible asymmetric portion rises above a base of the latch member, extends between an inner side and an outer side of the base of the latch member, and has an inward facing slope arising from the inner side of the base of the latch member and an outward facing slope arising from the outer sides of the base of the latch member; and a lock member mounted or formed on the second rail at a position of the second rail;

wherein the third rail has a positioning feature integrally formed on a floor of the third rail, the latch member has a base disposed parallel to the floor of the third rail with a positioning feature integrally formed thereon, and the positioning feature of the third rail and the positioning feature of the base of the latch member engage with one another to mount the latch member to the third rail, whereby the third rail moves together with the second rail when the latch member and the lock member are engaged, and the third rail moves freely by itself when the latch member and the lock member are disengaged, wherein the at least one resilient or compressible asymmetric portion can be compressed by the lock member in a direction perpendicular to the floor of the third rail such that the latch member may pass the lock member as the second and third rails move relatively so that as the second rail reaches a hard stop at its fully extended or retracted positions, the third rail can still be moved further to its fully extended or retracted positions.

2. The sliding track assembly of claim 1, wherein the second rail is mounted to the first rail and supported by a first ball bearing mechanism.

3. The sliding track assembly of claim 2, wherein the third rail is mounted to the second rail and supported by a second ball bearing mechanism.

4. The sliding track assembly of claim 1, wherein the base of the latch member further comprises a positioning feature engaged with a complimentary positioning feature provided on the third rail.

5. The sliding track assembly of claim 1, wherein the outward facing slope has a portion steeper than the inward facing slope.

6. The sliding track assembly of claim 1, wherein the lock member can engage the resilient or compressible asymmetric portion of the latch member from either an inward direction or an outward direction.

7. The sliding track assembly of claim 1, wherein the latch member or the lock member is made of a plastic material.

8. The sliding track assembly of claim 1, wherein the lock member is an aperture, groove, bump or bulge formed on the second rail.

9. A sliding track assembly, comprising a first rail having an inner end and an outer end;

a second rail having an inner end and an outer end, the second rail slidably mounted on and supported by the first rail such that the second rail is movable relative to the first rail;

a third rail having an inner end and an outer end, the third rail slidably mounted on and supported by the second rail such that the third rail is movable relative to the first rail and second rail;

a latch member mounted on the third rail at a position of the third rail, and having at least one resilient or compressible portion having an inward facing slope and an outward facing slope which has a portion steeper than the inward facing slope; and a lock member mounted on the second rail at a position of the second rail for engaging or compressing the resilient or compressible portion of the latch member from either an inward direction or an outward direction;

wherein the third rail has a positioning feature integrally formed on a floor of the third rail, the latch member has a base disposed parallel to the floor of the third rail with a positioning feature integrally formed thereon, and the positioning feature of the third rail and the positioning feature of the base of the latch member engage with one another to mount the latch member to the third rail, whereby the third rail moves together with the second rail when the latch member and the lock member are engaged, and the third rails moves freely by itself when the latch member and the lock member are disengaged, wherein the at least one resilient or compressible portion can be compressed by the lock member in a direction perpendicular to the floor of the third rail such that the latch member may pass the lock member as the second and third rails move relatively so that as the second rail reaches a hard stop at its fully extended or retracted positions, the third rail can still be moved further to its fully extended or retracted positions.

10. The sliding track assembly of claim 9, wherein the second rail is mounted to the first rail and supported by a first ball bearing mechanism, and the third rail is mounted to the second rail and supported by a second ball bearing mechanism.

11. The sliding track assembly of claim 9, wherein the latch member further comprises a positioning feature engaged with a complimentary positioning feature provided on the third rail.

12. The sliding track assembly of claim 9, wherein the resilient or compressible portion of the latch member has a curved portion interconnects the inward and outward facing slopes.

13. The sliding track assembly of claim 9, wherein the latch member or the lock member is made of a plastic material.

14. The sliding track assembly of claim 9, wherein the inward facing slope and outward facing slope of the latch member are asymmetric.

15. A sliding track assembly, comprising a first rail having an inner end and an outer end;

a second rail having an inner end and an outer end, the second rail slidably mounted on and supported by the first rail such that the second rail is movable relative to the first rail between a retracted position and an extended position;

a third rail having an inner end and an outer end, and a flat floor with a positioning feature integrally formed on the flat floor, the third rail slidably mounted on and supported by the second rail such that the third rail is movable relative to the first rail and second rail between a fully retracted position, a halfway position and a fully extended position;

a latch member having a base having an inner side and an outer side and two opposite lateral edges, the base being disposed parallel to the floor of the third rail and having a positioning feature integrally formed thereon which is engaged with the positioning feature on the third rail, such that the latch member is mounted on the third rail at a position near the outer end of the third rail with the two lateral edges of the latch member parallel to the elongated body of the third rail;

the latch member having at least one resilient or compressible portion rising above and between the inner and outer sides of the base of the latch member, the at least one resilient or compressible portion having an inward facing slope arising from the inner side of the base and an outward facing slope arising from the outer side of the base, and a curved portion interconnecting the inward facing and outward facing slopes, wherein the outward facing slope has a portion steeper than the inward facing slope; and a lock member mounted or formed on the second rail at a position adjacent to the outer end of the second rail for engaging and compressing the resilient or compressible portion of the latch member from either an inward direction or an outward direction;

whereby the third rail moves together with the second rail when the latch member and the lock member are engaged, and the third rails moves freely by itself when the latch member and the lock member are disengaged, wherein the at least one resilient or compressible asymmetric portion can be compressed by the lock member in a direction perpendicular to the floor of the third rail such that the latch member may pass the lock member as the second and third rails move relatively such that as the second rail reaches a hard stop at its fully extended or retracted positions, the third rail can still be moved further to its fully extended or retracted positions.

16. The sliding track assembly of claim 15, wherein the second rail is mounted to the first rail and supported by a first ball bearing mechanism, and the third rail is mounted to the second rail and supported by a second ball bearing mechanism.

17. The sliding track assembly of claim 15, wherein the latch member or the lock member is made of a plastic material.

* * * * *